US010163584B1

(12) United States Patent
Chen et al.

(10) Patent No.: US 10,163,584 B1
(45) Date of Patent: Dec. 25, 2018

(54) LOW-SILVER, LOW-PROFILE ELECTRICAL CONTACT APPARATUS AND ASSEMBLY

(71) Applicant: Siemens Industry, Inc., Alpharetta, GA (US)

(72) Inventors: Hai Chen, Duluth, GA (US); Mario Munoz, Buford, GA (US); Jesus Hernandez, Suwanee, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 15/610,725

(22) Filed: Jun. 1, 2017

(51) Int. Cl.
*H01H 1/02* (2006.01)
*H01H 1/06* (2006.01)
*H01H 1/22* (2006.01)

(52) U.S. Cl.
CPC ..... *H01H 1/06* (2013.01); *H01H 1/02* (2013.01); *H01H 1/22* (2013.01); *H01H 2201/03* (2013.01); *H01H 2203/00* (2013.01)

(58) Field of Classification Search
CPC ..... H01H 1/023; H01H 1/021; H01H 1/06; H01H 2203/00; G01R 1/06727
USPC ..... 218/127, 130, 132
See application file for complete search history.

(56) References Cited

U.S. PATENT DOCUMENTS

| | | | | |
|---|---|---|---|---|
| 4,607,148 | A | 8/1986 | Howell et al. | |
| 5,445,895 | A | 8/1995 | Behrens et al. | |
| 5,852,266 | A * | 12/1998 | Komuro | C22C 26/00 218/119 |
| 8,049,126 | B2 | 11/2011 | Chen et al. | |
| 2009/0200271 | A1 | 8/2009 | Chen et al. | |
| 2014/0002215 | A1 | 1/2014 | Ionescu et al. | |
| 2016/0196944 | A1 | 7/2016 | Ionescu et al. | |

* cited by examiner

*Primary Examiner* — Vanessa Girardi

(57) ABSTRACT

An electrical contact apparatus having low silver content and defined thickness and length geometry. The electrical contact apparatus has a contact body made of a silver-containing alloy having SC≤60 wt. %, and having L/T≥5.4, wherein L is a longest contact length dimension of the contact body, T is a maximum contact thickness dimension of the contact body, SC is the silver content in wt. %, and L/T is a contact dimension ratio. Electrical contact assemblies, circuit breaker electrical contact subassemblies, and methods of operating a circuit breaker electrical contact subassembly are disclosed, as are other aspects.

6 Claims, 5 Drawing Sheets

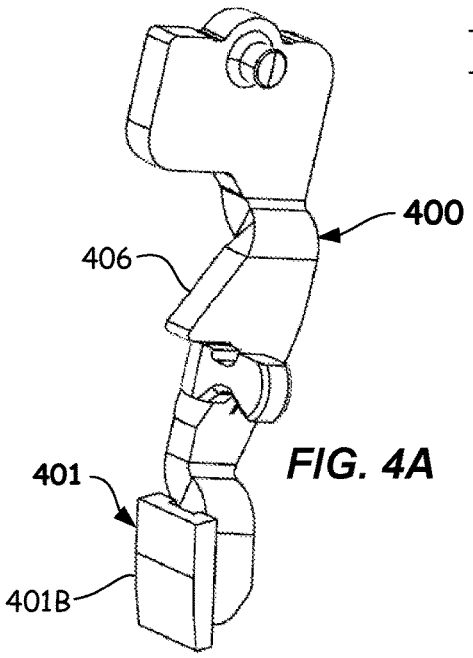
FIG. 4A
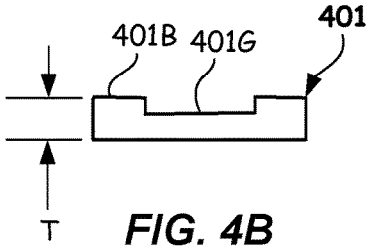
FIG. 4B
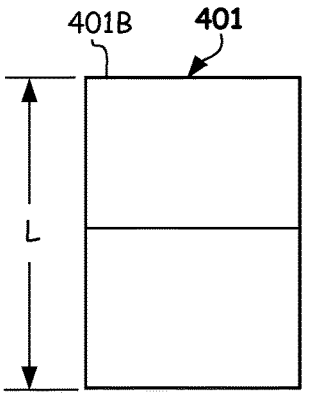
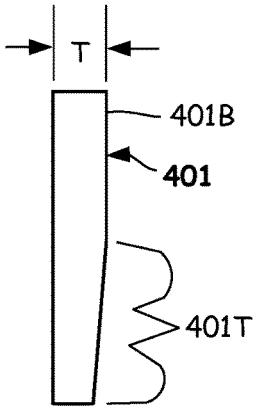
FIG. 4C FIG. 4D
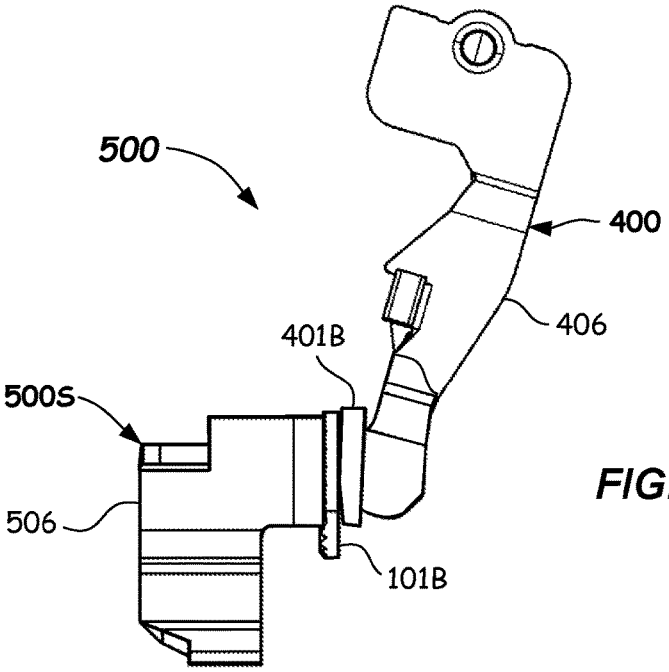
FIG. 5

LOW-SILVER, LOW-PROFILE ELECTRICAL CONTACT APPARATUS AND ASSEMBLY

FIELD

The present disclosure relates to electrical contacts, and more particularly to electrical contacts within electrical contact assemblies for electrical switching apparatus, such as electrical circuit breakers.

BACKGROUND

Electrical switching devices for electrical switching, such as circuit breakers, may need to survive multiple fault or short-circuit conditions, in which the electrical current through the electrical switching device may be many times larger than the device's continuous current rating (the so-called rated current). If such a fault current lasts for even a few seconds, the conductive parts of the electrical switching device may be degraded or even melt, and the electrical switching device may be destroyed, or otherwise may not continue to function as intended. This may possibly damage other components connected in the branch circuit protected by the electrical switching device. To ensure that such electrical switching devices (e.g., circuit breakers) are adequately designed for a particular handle rating, certain UL tests may be performed thereon.

Thus, certain electrical contact designs have evolved to be able to pass such UL tests and thus provide robust circuit breaker designs. However, in some instances, passing the UL tests may drive the electrical contacts to be quite expensive. Thus, electrical contact designs for electrical switching devices such as electrical circuit breakers that are adequate to pass the applicable UL testing, while also having lower cost are needed.

SUMMARY

In a first embodiment, an electrical contact apparatus is provided. The electrical contact apparatus includes a contact body made of a silver-containing alloy having SC≤60 wt. %, and having L/T≥5.4, wherein L is a longest contact length dimension of the contact body, T is a maximum contact thickness dimension of the contact body, SC is the silver content in wt. %, and L/T is a contact dimension ratio.

In another aspect, an electrical contact assembly is provided. The electrical contact assembly includes a contact support; and a contact body coupled to the contact support, the contact body made of a silver and tungsten alloy having 40 wt. %≤SC≤60 wt % and L/T≥5.4, wherein L is a longest contact length dimension of the contact body, T is a maximum contact thickness dimension of the contact body, SC is a silver content in wt. % of the contact body, and L/T is a contact dimension ratio.

In yet another aspect, a circuit breaker electrical contact subassembly is provided. The circuit breaker electrical contact subassembly includes a stationary contact support and a stationary contact body coupled to the stationary support, the stationary contact body made of a silver and tungsten alloy having 40 wt. %≤SC≤60 wt. % and Ls/Ts≥7.5, and a moveable contact support and a moveable contact body coupled to the moveable contact support, the moveable contact body made of a silver and tungsten alloy having 40 wt. %≤SC≤60 wt. % and Lm/Tm≥5.4, and wherein Ls and Lm are a longest contact length dimension of the stationary contact body and the moveable contact body, respectively, and Ts and Tm are a maximum contact thickness dimension of the stationary contact body and moveable contact body, respectively, and SC is a silver content in wt. %.

In a method embodiment, a method of operating a circuit breaker electrical contact subassembly is provided. The method includes providing the circuit breaker electrical contact subassembly including a stationary contact having a stationary contact body made of a silver-containing alloy having SC≤60 wt. %, and Ls/Ts≥7.5, and a moveable contact having a moveable contact body made of a silver-containing alloy having SC≤60 wt. % and Lm/Tm≥5.4, wherein Ls and Lm are a longest contact length dimension of the stationary contact body and moveable contact body, respectively, and Ts and Tm are a maximum contact thickness dimension of the stationary contact body and moveable contact body, respectively, and SC is a silver content in wt. %; initiating an arcing event under UL Z-sequence tests wherein re-ignition is avoided, and initiating an arcing event under UL X-sequence tests where temperature rise is sufficiently low such that the UL X-sequence tests are passed.

Still other aspects, features, and advantages of the present disclosure may be readily apparent from the following detailed description by illustrating a number of example embodiments, including the best mode contemplated for carrying out the present disclosure. The present invention may also be capable of different embodiments, and its several details may be modified in various respects, all without departing from the scope of the present disclosure. Accordingly, the drawings and descriptions are to be regarded as illustrative in nature, and not as restrictive. The invention is to cover all modifications, equivalents, and alternatives falling within the scope of the claims.

DESCRIPTION OF DRAWINGS

FIG. 4A illustrates an isometric view of a moveable electrical contact assembly including a low-profile, low-silver electrical contact apparatus according to embodiments.

FIG. 4B illustrates an end plan view of the low-profile, low-silver electrical contact apparatus of FIG. 4A according to embodiments.

FIG. 4C illustrates a front plan view of the low-profile, low-silver electrical contact apparatus of FIG. 4A according to embodiments.

FIG. 4D illustrates a side plan view of the low-profile, low-silver electrical contact of FIG. 4A according to embodiments.

FIG. 5 illustrates a side plan view of an electrical contact subassembly for a circuit breaker including a stationary electrical contact assembly including a low-profile, low-silver electrical contact apparatus and a moveable electrical contact assembly including a low-profile, low-silver electrical contact apparatus according to embodiments.

DETAILED DESCRIPTION

Figure 1A:
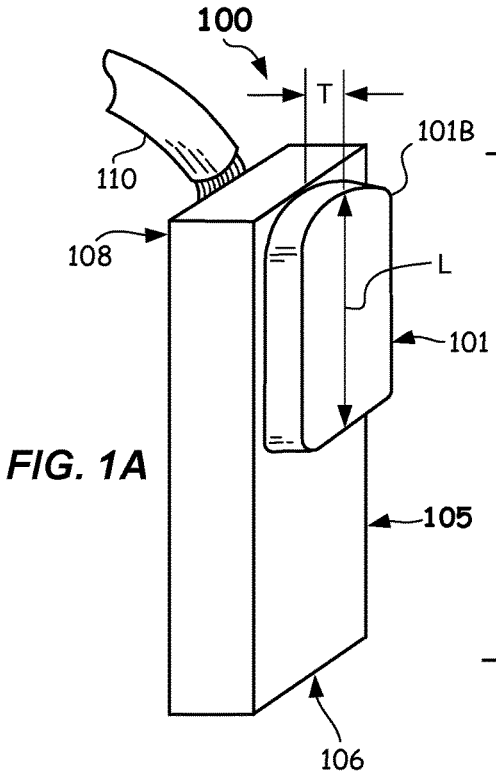
FIG. 1A illustrates an isometric view of a stationary electrical contact assembly according to embodiments.

Certain types of circuit breakers, such as 3-pole circuit breakers having circuit breaker handle ratings of between 60 A-100 A may have re-ignition issues during a UL Z-sequence test and/or temperature rise concerns during UL X-sequence test. The UL tests described herein are tested per UL 489 standard, version 12 (hereinafter referred to as "UL 489") are stringent and are intended to provide robust circuit breaker designs. 240-Volt 22-Kaic QE-type circuit breakers may be particularly prone to such technical issues. In other words, the design of electrical contacts and electrical contact assemblies in high-amperage circuit breakers, such as those having handle ratings of between 60 A-100 A, is particularly challenging to satisfy both requirements of both the UL Z-sequence testing as well as the UL X-sequence testing.

Use of conventional AgC4 material for the electrical contacts, which contains about 96% silver and about 4% carbon, have been used to mitigate re-ignition during UL Z-sequence testing under UL 489. However, the high silver content of the AgC4 electrical contacts adds unwanted expense to the circuit breaker. Accordingly, lower cost options are needed.

To lower cost of the electrical contact, the inventors hereof have experimented with lowering the silver content present within the electrical contact. However, the electrical contacts with lowered silver content may result in re-ignition issues during the UL Z-sequence tests and an untenable temperature rise during UL X-sequence tests per UL 489. However, the inventors herein have found that electrical contacts with less than about 60% silver content will effectively limit re-ignition issues during the UL Z-sequence tests and avoid significant temperature rise during UL X-sequence tests per UL 489, but only when certain geometrical changes to the physical structure of the electrical contact are carried out in combination with the lowered silver content.

In view of the foregoing difficulties, improved electrical contact apparatus, electrical contact assemblies, electrical contact subassemblies, and electrical switching apparatus, such as circuit breakers including the improved electrical contact apparatus are provided. In particular, the inventors hereof discovered that combinations of lowered silver content (SC) wherein SC≤60% coupled with an effectively larger and thinner electrical contact design provides performance improvements for both stationary and movable electrical contacts.

In accordance with embodiments, a large ratio of a longest length dimension L of the contact body of the electrical contact apparatus divided by a maximum contact thickness dimension T of the contact body helps reduce a total electrical resistance thereby improving electrical conductivity. Moreover, embodiments of the disclosure not only improve the electric conductivity of the electrical contact, but also improve the thermal conductivity or heat transfer characteristics thereof and therefore limit temperature rise when subjected to UL X-sequence testing per UL 489.

Embodiments of the disclosure provide improved electrical contact structure that is configured and adapted to provide suitable electrical conductivity and low cost and yet relatively low resistance to reduce temperature buildup in electrical contacts for 60 A-100 A handle-rated circuit breakers, such as 3-pole circuit breakers when undergoing UL Z-sequence and UL X-sequence tests under UL 289.

Embodiments of the electrical contact apparatus and electrical contact assemblies described herein are useful in high-current-rating circuit breakers, such as circuit breakers having handle ratings of 60 A to 100 A, but may also be used in other electrical switching devices including electrical contacts with similar current ratings. These and other embodiments of the electrical contact apparatus, electrical contact assemblies and subassemblies including the contact apparatus, and methods of operating the electrical contact assemblies are described below with reference to FIGS. 1A-7.

Referring now in specific detail to FIGS. 1A-1D, a first embodiment of an electrical contact assembly 100 including an improved electrical contact apparatus 101 for use in a circuit breaker or like electrical switching device is shown. The electrical contact assembly 100 including an improved electrical contact apparatus 101 has excellent utility for use in electrical switching devices, such as circuit breakers having a handle rating of 60 A to 100 A.

The electrical contact apparatus 101 may be used as a subcomponent of a larger electrical component, such as electrical contact assembly 100. One embodiment of electrical contact assembly 100 may comprise a stationary contact support 105, wherein the stationary contact support 105 is configured to attach to, or rigidly secured or retained by, a case (e.g., a molded case) of an electrical switching device. For example, in the embodiment shown in FIG. 1A, the stationary contact support 105 may include a first end 106 that is configured to be received in a pocket (not shown) of a molded case of a circuit breaker, for example. A second end 108 or any portion between the first end 106 and the second end 108 may have the electrical contact apparatus 101 affixed thereto by any suitable means. In one or more embodiments, the electrical contact apparatus 101 may be affixed by way of welding or the like. Also attached at the second end 108 or any portion between the first end 106 and the second end 108 may be a conductor 110. The conductor 110 may comprise a conductive path between a line terminal (not shown) and the stationary contact support 105. The conductor 110 may be a multi-strand copper braided, twisted, or combination of braided and twisted strands having an overall size approximately between about 14 gauge and 11 gauge, for example. The conductor 110 may include an insulating coating. Other sizes and types of conductor 110 may be used.

In more detail, the electrical contact apparatus 101 includes a contact body 101B that is made of a silver-containing alloy having SC≤60 wt. %, wherein SC is the silver content in wt. %. For example, the material may be a silver-containing alloy containing silver and another metal or metals. For example, the silver-containing alloy may comprise silver and tungsten alloy. For example, the silver/tungsten ratio may be 60/40, 55/45, 50/50, 45/55, or even 40/60 (or any ratio between 60/40 and 40/60). Thus, the contact body 101B may comprise SC≤55 wt. %, SC≤50 wt. %, SC≤45 wt. %, for example. In some embodiments, the contact body 101B may comprise 40 wt. %≤SC≤60 wt. % (including 60%, 59%, 58%, 57%, 56%, 55%, 54%, 53%, 52%, 51%, 50%, 49%, 48%, 47%, 46%, 45%, 44%, 43%, 41%, and 40% and any subrange therein).

In one embodiment, the contact body 101B may comprise an AgW50 material. Trace amounts of impurities of Cu, Zn, Si, Ca, Fe, Mg, and Cd may be present in less than about 100 ppm. In some embodiments, alloys of silver, Tungsten, and carbon may be used. The contact body 101B of the electrical contact apparatus 101 may have a hardness of at least 308 $N/mm^2$ as correlated to and measured by a Rockwell hardness method. The contact body 101B of the electrical contact apparatus 101 may have a Rockwell hardness of greater than or equal to 45 per Rockwell Superficial 30-T, which is converted from a Rockwell B measurement, for example.

Figure 1B:
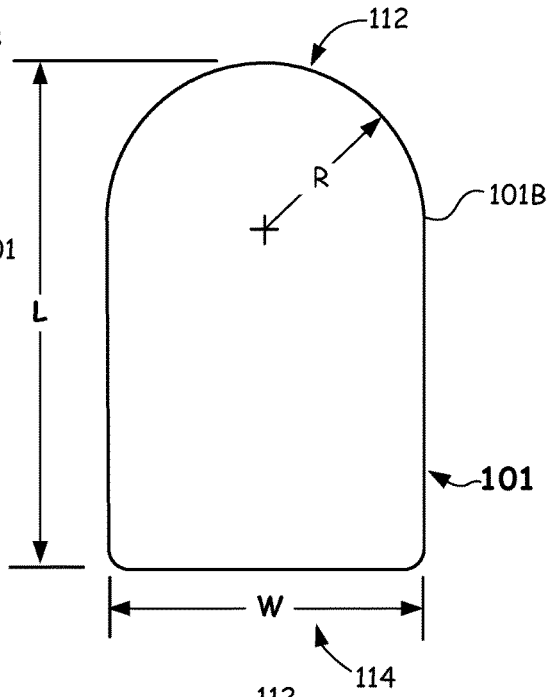
FIG. 1B illustrates a front plan view of a low-profile, low-silver stationary electrical contact of the stationary electrical contact assembly of FIG. 1A according to embodiments.
Figure 1C:
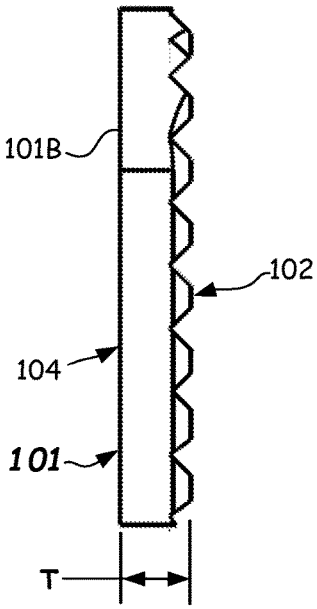
FIG. 1C illustrates a side plan view of a stationary electrical contact of the stationary electrical contact assembly of FIG. 1A according to embodiments.

In combination with the relatively low silver content (SC≤60%), electrical contact apparatus 101 includes a relatively high L/T ratio wherein L/T≥5.4. L/T is a contact dimension ratio, wherein L is a longest contact length dimension of the contact body 101B, and T is a maximum contact thickness dimension of the contact body 101B as best shown in FIGS. 1B and 10.

In embodiments, the contact body 101B of the electrical contact apparatus 101 may have a contact dimension ratio that is 5.4≤L/T≤10.0. Having SC≤60% and too high of a contact dimension ratio L/T may result in difficulties in manufacturing, whereas having SC≤60% and too low of a contact dimension ratio L/T may result in too high temperature rise under UL Z-Sequence testing. In some embodiments, contact body 101B of the electrical contact apparatus may comprise 5.4≤L/T≤7.5. For example, in some embodiments, the contact body 101B may be sized so that L/T≥6.5. In other embodiments, the contact body 101B may be sized so that L/T≥7.5. In some embodiments, the contact body 101B is a stationary electrical contact that is coupled to a stationary support (e.g., stationary contact support 105) and L/T≥7.5. In other embodiments to be described herein, the moveable contact body 401B (See FIG. 4A-4D) is coupled to a moveable contact support (E.g., moveable contact support 406) and L/T≥5.4.

By way of example, and not by limitation, the maximum contact thickness dimension T of the contact body 101B may be selected to be 0.89 mm≤T≤1.02 mm. Likewise, the longest contact length dimension L of the contact body 101B may be selected to be 7.62 mm≤L≤9.55 mm. Other sizes of the maximum contact thickness dimension T and the longest contact length dimension L may be used.

Further, various shapes of the contact body may be used. For FIG. 1A-1D illustrates one embodiment of contact body 101B wherein the front plan view is not symmetrical about at least one axis. For example, one end 112 of the contact body 101B may include a continuous arc from one lateral side to the other lateral side. The continuous arc may have an arc radius R (FIG. 1B) that is constant in some embodiments. The radius R may be between about 2.5 mm and 3.1 mm, for example. An opposite end 114 may have squared-off corners on each side. The corners on the opposite end 114 may include a slight radius thereon. The width W of the contact body 101B may be between about 5.0 mm and 6.0 mm, for example. Other widths W and Radii R may be used.

Figure 1D:
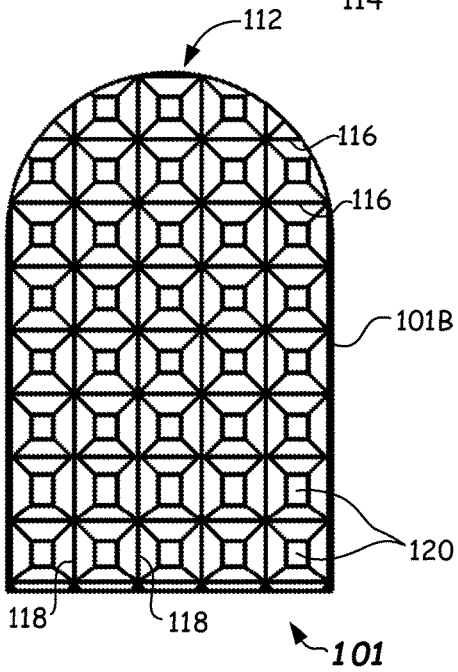
FIG. 1D illustrates a rear plan view of a stationary electrical contact of the stationary electrical contact assembly of FIG. 1A according to embodiments.
Figure 2A:
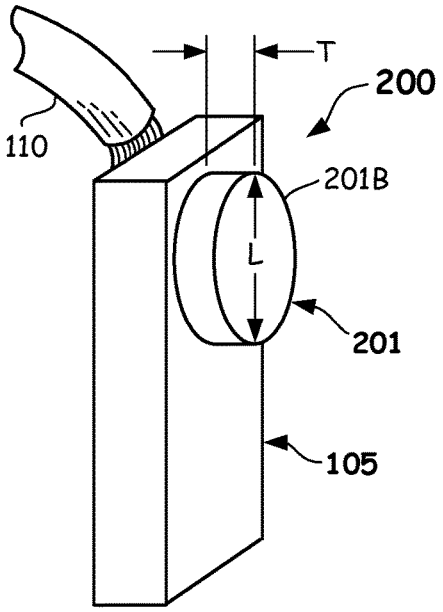
FIG. 2A illustrates an isometric view of another stationary electrical contact assembly according to embodiments.
Figure 2B:
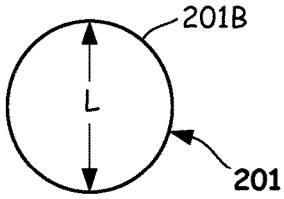
FIG. 2B illustrates a front plan view of a low-profile, low-silver stationary electrical contact of the stationary electrical contact assembly of FIG. 2A according to embodiments.
Figure 2C:
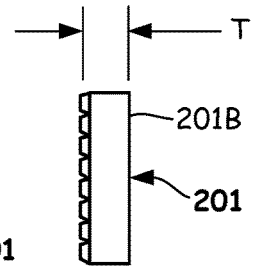
FIG. 2C illustrates a side plan view of a stationary electrical contact of the stationary electrical contact assembly of FIG. 2A according to embodiments.
Figure 3A:
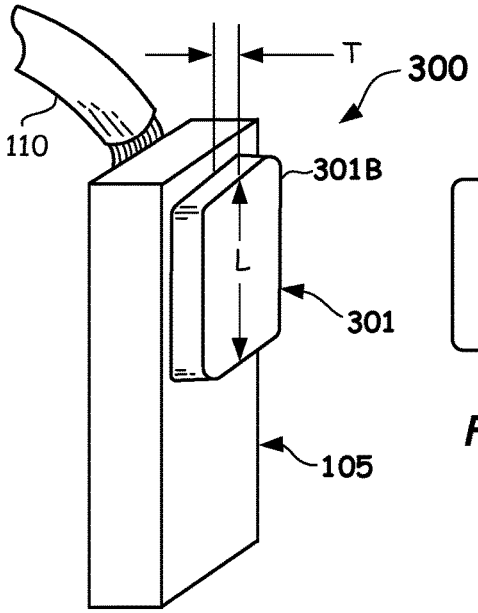
FIG. 3A illustrates an isometric view of another stationary electrical contact assembly according to embodiments.
Figure 3B:
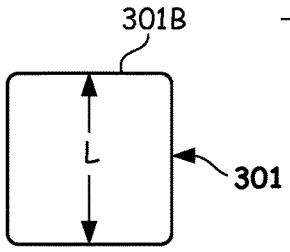
FIG. 3B illustrates a front plan view of a low-profile, low-silver stationary electrical contact of the stationary electrical contact assembly of FIG. 3A according to embodiments.
Figure 3C:
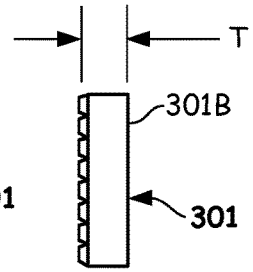
FIG. 3C illustrates a side plan view of a stationary electrical contact of the stationary electrical contact assembly of FIG. 3A according to embodiments.

As shown in FIGS. 10 and 1D, the back side of the contact body 101B may include a crisscrossed pattern of grooves 116, 118, which provides a roughened surface suitable for welding the contact body 101B to the stationary contact support 105. The grooves 116, 118 may comprise V-grooves of a depth sufficient to leave a plurality of rectangular support portions 120. Grooves may be formed by machining, pressing, stamping, casting, or the like. The welding may be provided by an suitable welding process such as induction or resistance welding.

Another embodiment of an electrical contact assembly 200 is shown in FIGS. 2A-2D. This embodiment is constructed similarly to the embodiment described in FIGS. 1A-1D, however, the electrical contact apparatus 201 comprises a contact body 201B including a circular outer periphery shape when viewed in front plan view. The contact body 101 as shown is a stationary electrical contact that is coupled to a stationary contact support (e.g., stationary contact support 105) and comprises geometry wherein L/T≥7.5. In particular, the maximum length dimension L may be 7.62 mm≤L≤9.55 mm, for example. The maximum thickness dimension T may be 0.89 mm≤T≤1.02 mm, for example. The silver content SC may be as described above. The electrical contact assembly 200 may include a stationary contact support 105 and a coupled conductor 110 the same or similar to that previously described.

Another embodiment of an electrical contact assembly 300 is shown in FIGS. 3A-3D. This embodiment is constructed similarly to the embodiment described in FIGS. 1A-1D, except that the electrical contact apparatus 301 comprises a contact body 301B including a rectangular outer periphery shape when viewed in front plan view. The contact body 301 as shown is a stationary electrical contact that is coupled to a stationary contact support (e.g., stationary contact support 105) and comprises geometry wherein L/T≥7.5. In particular, the maximum length dimension L may be 7.62 mm≤L≤9.55 mm, for example. The maximum thickness dimension T may be 0.89 mm≤T≤1.02 mm, for example. The silver content SC may be as described above. The electrical contact assembly 300 may include a stationary contact support 105 and a coupled conductor 110 the same or similar to that previously described.

Another embodiment of a moveable electrical contact assembly 400 is shown in FIGS. 4A-4D. In this embodiment, the electrical contact apparatus 401 comprises a moveable electrical contact. The moveable electrical contact assembly 400 comprises a moveable contact support 406 such as a moveable contact arm, and the electrical contact apparatus 401 coupled thereto. The electrical contact apparatus 401 includes a moveable contact body 401B including a rectangular outer periphery shape when viewed in front plan view (FIG. 4C). The moveable contact body 401B as shown is a moveable electrical contact that is coupled to a moveable contact support (e.g., moveable contact support 406) and comprises geometry wherein L/T≥5.4. In particular, the maximum length dimension L may be and the maximum thickness dimension T may be as described above, for example. The silver content SC may be as described above. The moveable electrical contact assembly 400 may include a coupled conductor (not shown) that may couple to a bimetal (not shown).

As is best shown in FIGS. 4C and 4D, the moveable contact body 401B may include a tapered portion 401T located on one end. The tapered portion 401T may taper from a maxim thickness dimension T to a value less than the maximum thickness dimension, such as less than about 35% of the maxim thickness dimension T. The tapered portion 401T may start at a point beyond approximately half of the maximum length dimension L. The tapered portion 401T may help move the arc away from the moveable contact support 406 and may help avoid contact welding. An underside of the moveable contact body 401B may include a groove 401G along a length thereto that is sized to receive a portion of the moveable contact support 406 therein. Like the stationary contact, the moveable contact body 401B is welded to the end of the moveable contact support 406 by a suitable welding process such as induction or resistance welding.

FIG. 5 depicts an embodiment of a circuit breaker electrical contact subassembly 500. The circuit breaker electrical contact subassembly 500 includes a stationary electrical contact assembly 500S and a moveable electrical contact assembly 400 that are engageable with one another to open and close a circuit connected. In the depicted embodiment, the stationary electrical contact assembly 500S comprises a stationary contact support 506 and a stationary contact body 101B coupled to the stationary contact support 506, such as by welding. In the depicted embodiment, the stationary contact support 506 is configured as a stab terminal connector which is C-shaped and configured to straddle a stab of a panelboard. The stationary contact body 101B is made of a silver and tungsten alloy having a silver content expressed by: 40 wt. %≤SC≤60 wt. % and having a geometrical configuration where Ls/Ts≥7.5, wherein the subscript s stands for stationary. Ts and Ls are defined the same way as T and L in FIGS. 1B and 1C.

The moveable electrical contact assembly 400 comprises a moveable contact support 406 and a moveable contact body 401B coupled to the moveable contact support 406, such as by welding. The moveable contact body 401B is made of a silver and tungsten alloy having a silver content defined by: 40 wt. %≤SC≤60 wt. % and having a geometrical configuration where Lm/Tm≥5.4. Lm is a longest contact length dimension of the moveable contact body 401B, and Tm is a maximum contact thickness dimension of the moveable contact body 401B. Tm and Lm are defined the same way as T and L in FIGS. 4C and 4D.

Figure 6A:
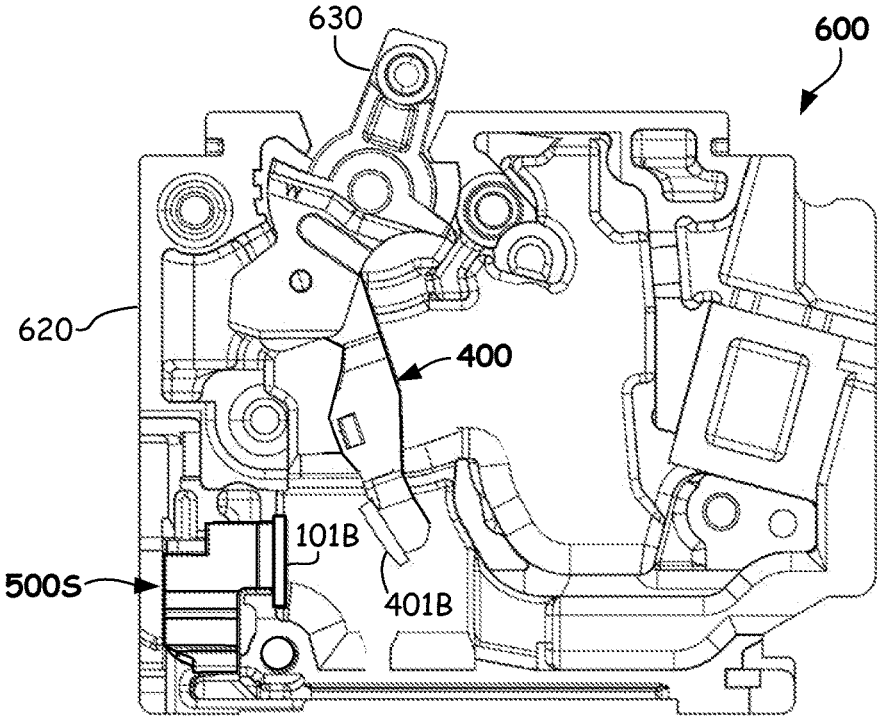
FIG. 6A illustrates a side plan view of a circuit breaker including an electrical contact subassembly including a stationary electrical contact assembly including a low-profile, low-silver electrical contact apparatus and a moveable electrical contact assembly including a low-profile, low-silver electrical contact apparatus according to embodiments, shown in an opened contact configuration.
Figure 6B:
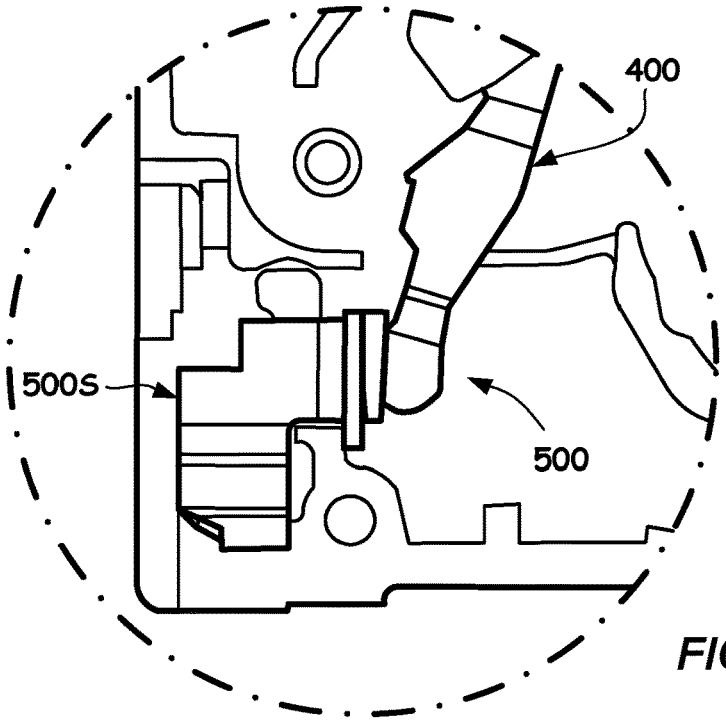
FIG. 6B illustrates an enlarged partial side plan view of a circuit breaker including an electrical contact subassembly including a stationary electrical contact assembly including a low-profile, low-silver electrical contact apparatus and a moveable electrical contact assembly including a low-profile, low-silver electrical contact apparatus according to embodiments, shown in a closed contact configuration.

FIGS. 6A and 6B depict an embodiment of a circuit breaker 600 including the circuit breaker electrical contact subassembly 500 described in FIGS. 5A and 5B. Circuit breaker 600 may have a circuit breaker handle rating of between 60 A to 100 A. The stationary electrical contact assembly 500S and a moveable electrical contact assembly 400 are shown engaged in enlarged view FIG. 6B and are shown separated in FIG. 6A. The circuit breaker electrical contact subassembly 500 is retained with a molded case 620 (one side half removed for clarity) of the circuit breaker 600. The stationary electrical contact assembly 500S is retained in the molded case 620 by support features molded into the molded case 620. In the depicted embodiment, the moveable electrical contact assembly 400 is moveable by an operating handle 630. The remaining standard components of the circuit breaker, such as the load terminal, load conductor, magnet, bi-metal assembly, armature, and conductor coupled to the moveable contact support 406 are not shown, but are entirely conventional.

Figure 7:
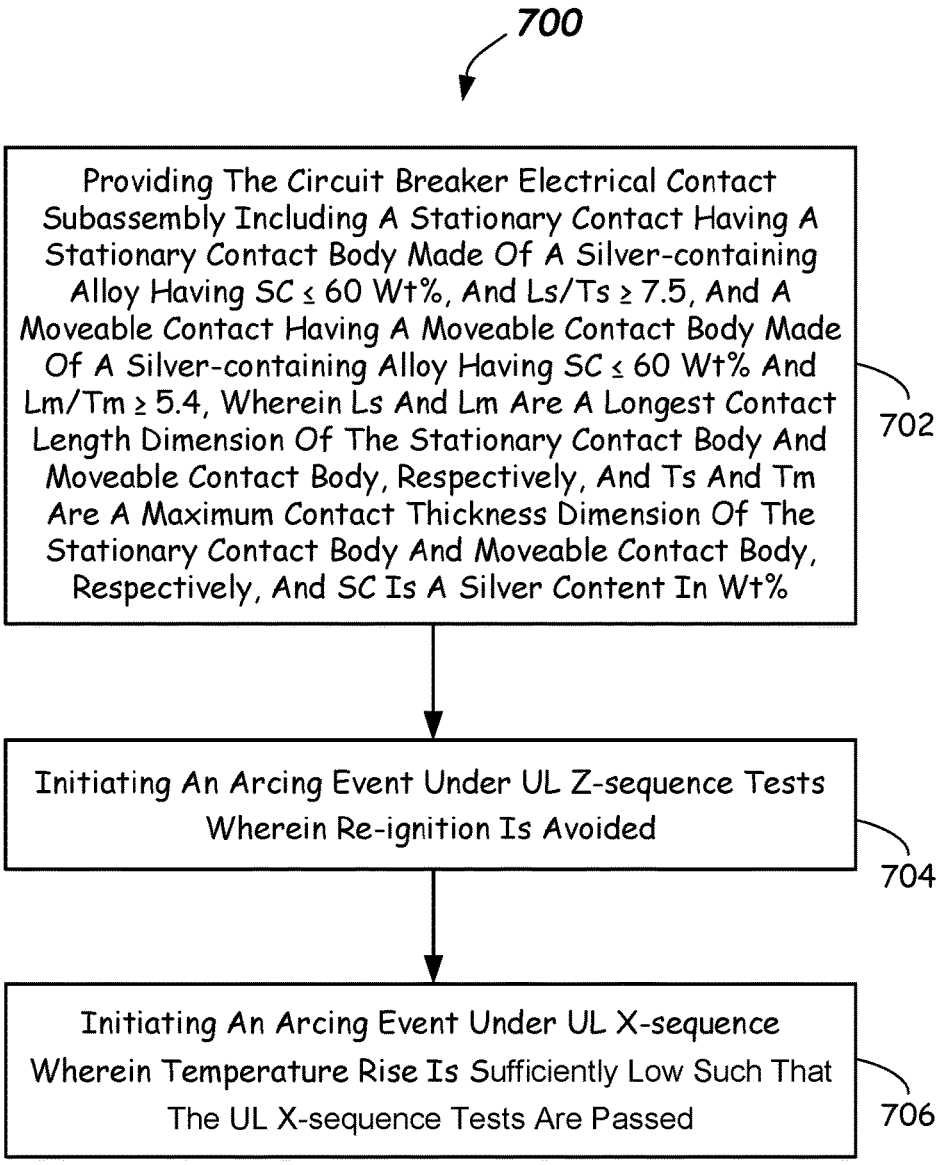
FIG. 7 illustrates a flowchart of a method of operating an electrical contact apparatus so that re-ignition under UL Z-sequence tests is avoided and temperature rise are sufficiently low so that UL X-sequence tests are passed according to embodiments.

FIG. 7 illustrates a flowchart of a method of operating a circuit breaker electrical contact subassembly (e.g., 500) according to embodiments. The method 700 includes, in 702, providing the circuit breaker electrical contact subassembly (e.g., 500) including a stationary contact (e.g., 101) having a stationary contact body (e.g., 101B) made of a silver-containing alloy having SC≤60 wt. %, and Ls/Ts≥7.5, and a moveable contact (e.g., 401) having a moveable contact body (e.g., 401B) made of a silver-containing alloy having SC≤60 wt. % and Lm/Tm≥5.4, wherein Ls and Lm are a longest contact length dimension of the stationary contact body (e.g., 101B) and moveable contact body (e.g., 401B), respectively, and Ts and Tm are a maximum contact thickness dimension of the stationary contact body (e.g., 101B) and moveable contact body (e.g., 401B), respectively, and SC is a silver content in wt. %.

The method 700 further comprises, in 704, initiating an arcing event under UL Z-sequence tests (per UL 489 standard) wherein re-ignition is avoided, and, in 706, initiating an arcing event under UL X-sequence tests where temperature rise is sufficiently low such that the UL X-sequence tests (per UL 489 standard) are passed. In some embodiments, temperature rise of less than or equal to 50° C. is avoided. In other embodiments, temperature rise under UL X-sequence testing of less than or equal to 65° C. is avoided.

Specific apparatus, assembly embodiments, and methods thereof have been shown by way of example in the drawings and are described in detail herein. It should be understood, however, that it is not intended to limit the disclosure to the particular apparatus, assemblies, or methods disclosed, but, to the contrary, the intention is to cover all modifications, equivalents, and alternatives falling within the scope of the claims.

What is claimed is:

1. A circuit breaker electrical contact subassembly, comprising:

a stationary contact support and a stationary contact body coupled to the stationary contact support, the stationary contact body made of a silver and tungsten alloy having 40 wt. % more than or equal to (≤) SC less than or equal to (≤) 60 wt. % and Ls/Ts more than or equal to (≥) 7.5, and a moveable contact support and a moveable contact body coupled to the moveable contact support, the moveable contact body made of a silver and tungsten alloy having 40 wt. % more than or equal to (≤) SC less than or equal to (≤) 60 wt. % and 5.4 more than or equal to (≤) Lm/Tm less than (<) 7.5, and wherein Ls and Lm are a longest contact length dimension of the stationary contact body and the moveable contact body, respectively, and Ts and Tm are a maximum contact thickness dimension of the stationary contact body and moveable contact body, respectively, and SC is a silver content in wt. %.

2. The circuit breaker electrical contact subassembly of claim 1, wherein the stationary contact body has a Rockwell hardness Superficial 30-T of greater than or equal to 45.

3. The circuit breaker electrical contact subassembly of claim 1, wherein the stationary contact body comprises an AgW50 material and the moveable contact body comprises the AgW50 material.

4. The circuit breaker electrical contact subassembly of claim 1, comprising:

$0.89\ mm \leq Ts \leq 1.02\ mm$.

5. The circuit breaker electrical contact subassembly of claim 1, comprising:

$7.62\ mm \leq Ls \leq 9.55\ mm$.

6. The circuit breaker electrical contact subassembly of claim 1, included in a circuit breaker having a circuit breaker handle rating of between 60 A to 100 A.

* * * * *